US010337285B2

(12) United States Patent
Kellner

(10) Patent No.: US 10,337,285 B2
(45) Date of Patent: Jul. 2, 2019

(54) TIME-DELAYED DOWNHOLE TOOL

(71) Applicant: TEAM OIL TOOLS, LP, The Woodlands, TX (US)

(72) Inventor: Justin Kellner, Adkins, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 207 days.

(21) Appl. No.: 15/381,515

(22) Filed: Dec. 16, 2016

(65) Prior Publication Data

US 2018/0163508 A1 Jun. 14, 2018

Related U.S. Application Data

(60) Provisional application No. 62/432,987, filed on Dec. 12, 2016.

(51) Int. Cl.

| | |
|---|---|
| ***E21B 34/00*** | (2006.01) |
| ***E21B 34/06*** | (2006.01) |
| ***E21B 34/10*** | (2006.01) |

(52) U.S. Cl.

CPC ..... *E21B 34/10* (2013.01); *E21B 34/063* (2013.01); *E21B 34/102* (2013.01); *E21B 34/108* (2013.01); *E21B 2034/007* (2013.01)

(58) Field of Classification Search

CPC ..... E21B 34/10; E21B 34/063; E21B 34/108; E21B 34/102; E21B 34/103; E21B 2034/007

See application file for complete search history.

(56) References Cited

U.S. PATENT DOCUMENTS

| | | | | |
|---|---|---|---|---|
| 4,429,747 A * | 2/1984 | Williamson, Jr. | ..... | E21B 34/14 166/321 |
| 6,293,342 B1 * | 9/2001 | McGarian | ..... | E21B 21/10 166/317 |
| 7,108,071 B2 * | 9/2006 | Freiheit | ..... | E21B 21/103 166/323 |
| 7,926,573 B2 * | 4/2011 | Swan | ..... | E21B 21/103 166/319 |
| 8,267,178 B1 * | 9/2012 | Sommers | ..... | E21B 34/102 166/334.4 |

(Continued)

OTHER PUBLICATIONS

Author Unknown, ZoneSelect® Completions System Time Delay (TD) Toe Sleeve, Weatherford®, 2013, pp. 1-2.

*Primary Examiner* — Jennifer H Gay

(74) *Attorney, Agent, or Firm* — MH2 Technology Law Group LLP

(57) ABSTRACT

A downhole tool and method, of which the downhole tool includes a first sub defining a port extending radially therethrough, a second sub spaced apart from the first sub, and a housing connected with the first and second subs. A valve element is disposed at least partially within the housing, and is movable from a closed position to an open position. In the closed position, the valve element blocks fluid communication between a bore and an opening in the housing. When the valve element is in the open position, fluid communication between the bore and the opening is permitted. An actuation chamber is defined between the first sub, the housing, and the valve element, and is in fluid communication with the bore via a flow path that includes the port. A flow restrictor in the flow path is configured to slow fluid flow from the bore to the actuation chamber.

24 Claims, 6 Drawing Sheets

(56) References Cited

U.S. PATENT DOCUMENTS 9,121,247 B2 * 9/2015 George ..... E21B 34/063
9,121,252 B2 * 9/2015 George ..... E21B 34/108
9,359,864 B2 * 6/2016 Harris ..... E21B 34/101
9,441,440 B2 * 9/2016 Hofman ..... E21B 33/00
9,476,282 B2 * 10/2016 Anton ..... E21B 34/063
9,567,832 B2 * 2/2017 Hofman ..... E21B 34/063
9,650,866 B2 * 5/2017 George ..... E21B 34/108
9,670,750 B2 * 6/2017 Chauffe ..... E21B 34/102
9,915,122 B2 * 3/2018 Hofman ..... E21B 34/063
9,976,386 B2 * 5/2018 Harris ..... E21B 34/101
10,066,461 B2 * 9/2018 Hardesty ..... E21B 34/063
2009/0095463 A1 * 4/2009 Swan ..... E21B 21/103 166/53
2012/0031623 A1 * 2/2012 Elrick ..... E21B 34/103 166/369
2012/0111574 A1 * 5/2012 Desranleau ..... E21B 34/14 166/373
2014/0116721 A1 * 5/2014 Hofman ..... E21B 33/00 166/373
2014/0251619 A1 * 9/2014 George ..... E21B 34/063 166/305.1
2014/0251620 A1 * 9/2014 George ..... E21B 34/108 166/305.1
2014/0251636 A1 * 9/2014 Hofman ..... E21B 34/063 166/373
2014/0374096 A1 * 12/2014 Anton ..... E21B 34/063 166/285
2015/0041133 A1 * 2/2015 Chauffe ..... E21B 34/102 166/284
2015/0129205 A1 * 5/2015 Hofman ..... E21B 34/063 166/250.01
2015/0218916 A1 * 8/2015 Richards ..... E21B 34/14 166/278
2015/0233208 A1 * 8/2015 Muscroft ..... E21B 34/063 166/374
2015/0315873 A1 * 11/2015 Mailand ..... E21B 34/125 166/307
2015/0369007 A1 * 12/2015 George ..... E21B 34/108 166/305.1
2015/0369008 A1 * 12/2015 Shaffer ..... E21B 34/063 166/298
2015/0369009 A1 * 12/2015 George ..... E21B 34/063 166/374
2015/0369011 A1 * 12/2015 Hardesty ..... E21B 34/063 166/305.1
2015/0369040 A1 * 12/2015 George ..... E21B 34/063 166/250.08
2016/0003005 A1 * 1/2016 Pickle ..... E21B 34/10 166/374
2016/0084039 A1 * 3/2016 Harris ..... E21B 34/101 137/12
2016/0237781 A1 * 8/2016 Bacsik ..... E21B 34/063
2016/0237786 A1 * 8/2016 Harris ..... E21B 34/101
2017/0254175 A1 * 9/2017 Provost ..... E21B 34/066
2017/0342806 A1 * 11/2017 Themig ..... E21B 43/14
2018/0163508 A1 * 6/2018 Kellner ..... E21B 34/10

* cited by examiner

TIME-DELAYED DOWNHOLE TOOL

CROSS-REFERENCE TO RELATED APPLICATIONS

This application claims priority to U.S. Provisional Application having Ser. No. 62/432,987, which was filed on Dec. 12, 2016 and is incorporated herein by reference in its entirety.

BACKGROUND

Hydrocarbon products such as oil and natural gas are generally extracted from wells drilled into the earth. One aspect of drilling such wells is known as "completion." Completion is the process of making a well ready for production or injection. There are several techniques to complete a well. Such techniques generally involve lining the well with casing, and cementing the casing in place.

Cementing operations begin by pumping cement down into casing and back up through the annulus between the casing and the wall of the wellbore. After filling the annulus with cement, an operator typically wipes the wellbore by pumping a wiper device such as a wiper plug, dart, or ball through the casing. The wiper device is designed as a barrier to prevent cement contamination with displacement of wellbore fluids as well as to "wipe" excess or superfluous cement from the string.

After cementation, the wellbore is reopened downhole to allow circulation of fluids to continue the completion process. In some cases, this is done using a downhole tool known as a "toe valve" or an "initiation valve." However, in some instances, the toe valve may fail to open and can block circulation. One factor that plays a role in these failures is cement left behind in the toe valve that the cement wiper plug did not remove.

SUMMARY

Embodiments of the disclosure may provide a downhole tool including a first sub defining a port extending radially therethrough, a second sub spaced axially apart from the first sub, and a housing connected with the first and second subs. A valve element is disposed at least partially within the housing, and is movable from a closed position to an open position. In the closed position, the valve element blocks fluid communication between a bore and an opening in the housing, and when the valve element is in the open position, fluid communication between the bore and the opening is permitted. an actuation chamber defined between the first sub, the housing, and the valve element, the actuation chamber being in fluid communication with the bore via a flow path that includes the port, and a flow restrictor positioned in the flow path. The flow restrictor is configured to slow fluid flow from the bore to the actuation chamber via the flow path, while allowing fluid flow from the bore to the actuation chamber via the flow path.

Embodiments of the disclosure may also provide a method for operating a downhole tool. The method includes deploying the downhole tool into a wellbore, the downhole tool including a sleeve that is initially held in a closed position. The sleeve in the closed position blocks fluid communication between a central bore of the downhole tool and an exterior of the downhole tool via an opening in the downhole tool. The method also includes causing an increase in a pressure in the central bore by increasing a pressure in the wellbore, and maintaining the pressure in the central bore at least until a pressure in an actuation chamber defined within the downhole tool reaches an actuation pressure. Pressure changes in the actuation chamber are delayed with respect to pressure changes in the central bore. The method further includes producing a pressure differential across the sleeve by reducing the pressure in the wellbore. Producing the pressure differential causes the sleeve to move a first time toward an open position. The sleeve in the open position exposes the opening to the central bore for allowing communication between the central bore and the exterior of the downhole tool.

BRIEF DESCRIPTION OF THE DRAWINGS

The present disclosure may best be understood by referring to the following description and accompanying drawings that are used to illustrate one or more embodiments. In the drawings.

DETAILED DESCRIPTION

Figure 1:
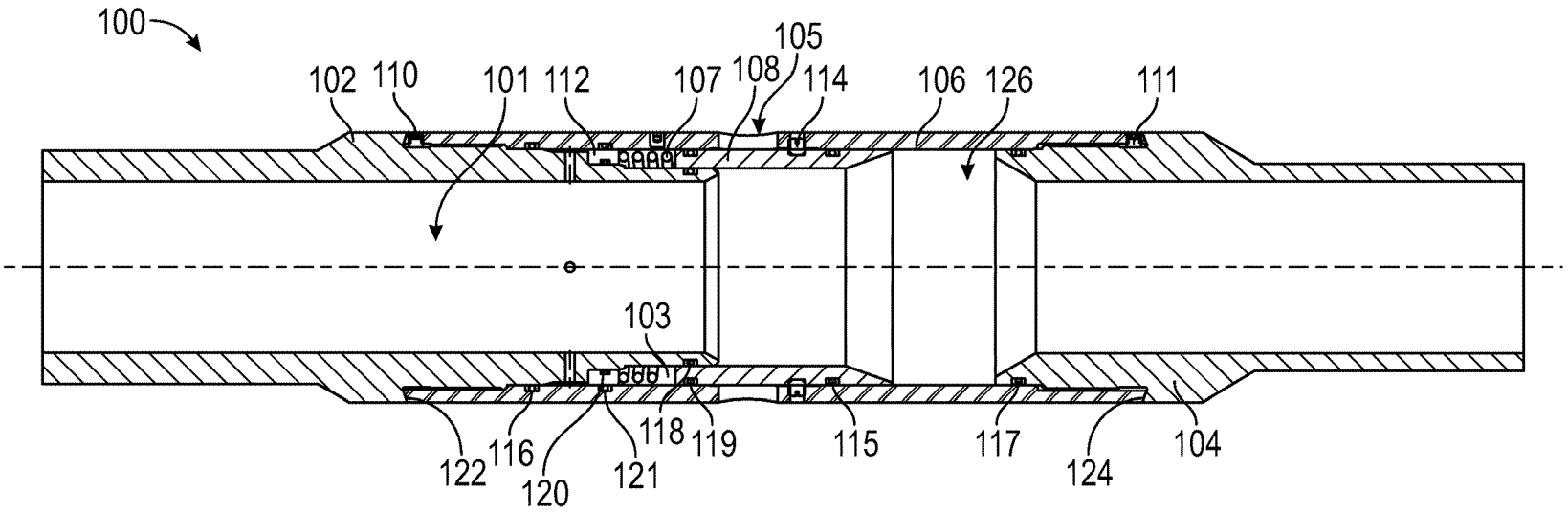
FIG. 1 illustrates a cross-sectional side view of a downhole tool in a closed configuration, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

In general, the present disclosure provides a downhole tool, e.g., a valve that may be used as a toe valve in wellbore completions. The valve operates to selectively expose an opening that provides an initial injection point for hydraulic fracturing of the surrounding formation. The valve may be run downhole with casing while the valve in a closed configuration. Upon reaching a desired depth, the valve may be configured to initially remain closed, continuing to prevent fluid communication between an interior bore of the valve and an exterior of the valve, until an actuation event occurs, such as when a casing bore pressure test completes. The actuation event may trigger the valve to open, thereby exposing the casing bore to the wellbore. The valve opening, however, may be delayed, e.g., occurring after a predetermined amount of time passes from when the actuation event occurs. For example, the valve may include a valve element (e.g., a sleeve) that is movable in response to increases in pressure in the casing. However, fluid communication to the valve element may be constricted, which may delay the valve opening following the actuating event. Various other aspects of the present disclosure will be apparent from the following description of several example embodiments.

Turning now to the illustrated embodiments, FIG. 1 depicts a cross-sectional side view of a downhole tool (e.g., a valve) 100 in a closed configuration, according to an embodiment. The tool 100 may generally include a first sub 102 and a second sub 104, connected together by a housing 106. The first sub 102, the housing 106, and the second sub 104 may together define a central bore 101 extending axially through the tool 100. The first and second subs 102, 104 and the housing 106 may be concentric, i.e., disposed about a common central axis. Further, the first and second subs 102, 104 may be spaced axially apart, defining a cavity 126 therebetween, with the housing 106 spanning the cavity 126 as shown (the cavity 126 may also, in some embodiments, be considered generally part of the bore 101). The subs 102, 104 may each contain a recess 122, 124, respectively, in which the housing 106 is received. The connection between the housing 106 and the subs 102, 104 may be a threaded connection and may be secured with fasteners, such as set screws 110, 111. In other embodiments, the subs 102, 104 may be connected to the housing 106 in any other manner. Seals 116, 117 may be positioned between the housing 106 and the subs 102, 104, respectively.

The housing 106 may define one or more openings 105 radially therethrough. When the tool 100 is opened, the openings 105 may fluidly communicate with the bore 101, allowing communication from the bore 101 to the exterior of the tool 100.

The tool 100 may include a valve element that opens and closes the tool 100. In an embodiment, the valve element may be a sleeve 108 that is positioned generally concentric to and at least partially radially between the first sub 102 and the housing 106 and/or between the second sub 104 and the housing 106. The sleeve 108 may be movable, e.g., slidable relative to the first sub 102, the second sub 104, and/or the housing 106, between a closed position (as shown) and an open position (to the right of what is shown). In the closed position, the sleeve 108 may extend across the openings 105 and block fluid communication between the bore 101 and the openings 105. Further, in the closed position, the sleeve 108 may seal against the first sub 102 and the housing 106 using seals 115, 118, 119. In the closed position, the sleeve 108 may also be axially constrained from movement with respect to the housing 106 by a shearable member 114, such as a shear pin or shear screw, that connects the shearable member 114 to the housing 106. In response to an actuation event, as will be described in greater detail below, the sleeve 108 may slide to the right (e.g., in the downhole direction), so as to expose the openings 105 to the bore 101. This is the open position for the sleeve 108, which corresponds to the tool 100 being open.

The tool 100 may generally include an actuating mechanism configured to effect such sliding of the sleeve 108 and thereby open the sleeve 108. The actuating mechanism may also provide the aforementioned time-delay for such opening. The actuating mechanism may include, for example, an actuation chamber 103 and a flow restrictor which may slow fluid flow into the actuation chamber 103, while allowing fluid to flow; that is, the flow restrictor may be configured to limit the non-zero rate of fluid flow, e.g., by limiting the flow path area, e.g., choking flow. In one example, the flow restrictor may be or include a one-way valve assembly 112, as shown.

The sleeve 108 may be movable in response to the actuation chamber 103 and the bore 101 reaching a predetermined pressure differential. The actuation chamber 103 may be in fluid communication with the bore 101 through the one-way valve assembly 112. The one-way valve assembly 112 may, however, impede fluid flow to the actuation chamber 103, thus allowing the pressure to increase in the chamber 103 in response to pressure increases in the bore 101, but over a period of time.

In a specific embodiment, the one-way valve assembly 112 is located generally concentric with and radially between the first sub 102 and the housing 106. The one-way valve assembly 112 may seal against the first sub 102 and the housing 106 using seals 120 and 121 respectively. Further, the chamber 103 may be defined between (e.g., by) the first sub 102, the housing 106, the sleeve 108, and the one-way valve assembly 112.

The actuating mechanism may also include a biasing member (e.g., a spring) 107, which may be positioned within the chamber 103, to assist with sliding the sleeve 108. For example, the biasing member 107 may bear on the housing 106 on one side, and the sleeve 108 on the other. In other embodiments, the biasing member 107 may bear on the first sub 102 instead of the housing 106. The biasing member 107 may be compressed when the sleeve 108 is in the closed position. Accordingly, the biasing member 107 may apply an axial force on the sleeve 108, directed away from the first sub 102 and toward the open position of the sleeve 108.

Figure 2:
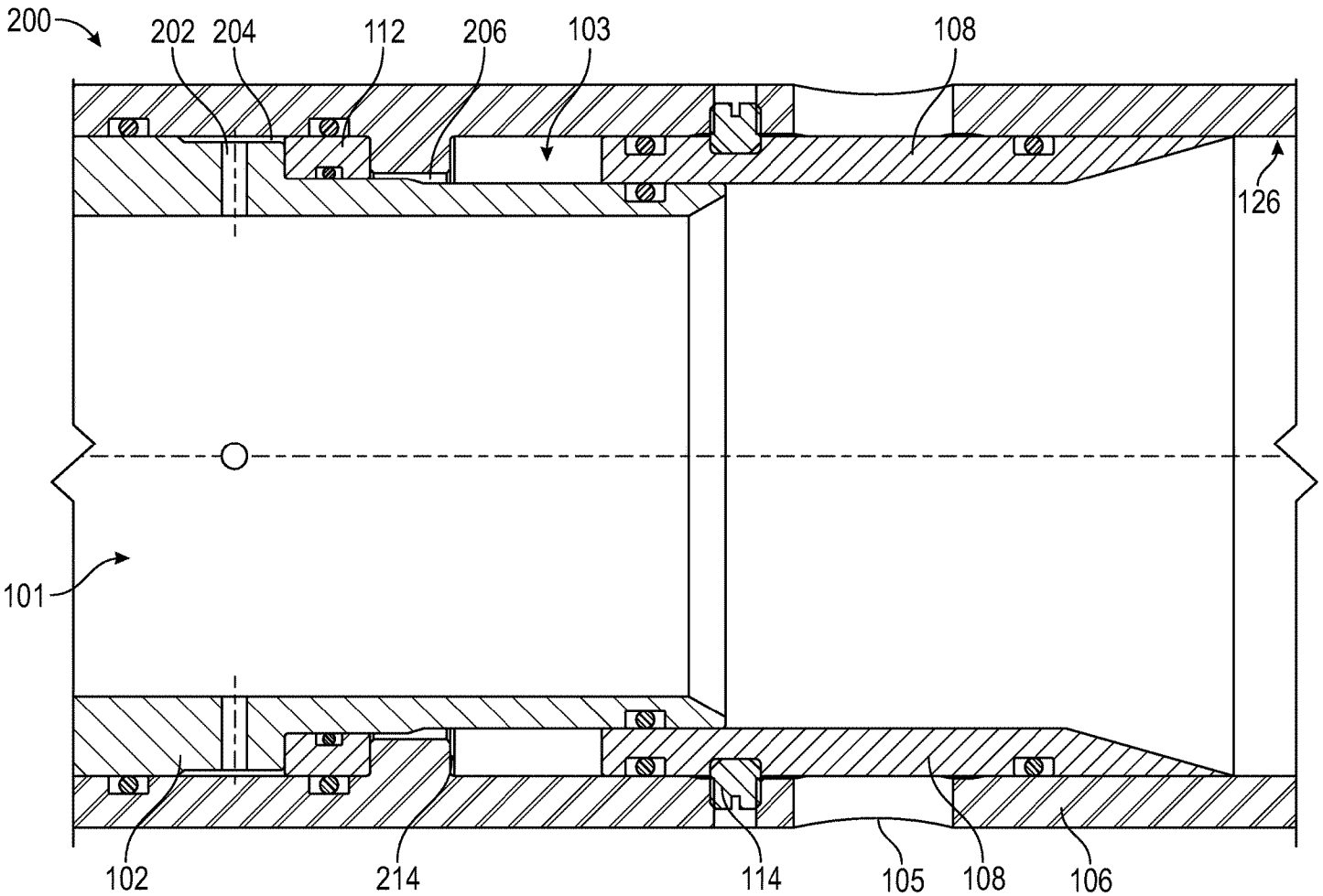
FIG. 2 illustrates an enlarged cross-sectional view of a portion of the downhole tool, depicting an actuating mechanism thereof in greater detail, according to an embodiment.

FIG. 2 illustrates an enlarged view of the tool 100, showing additional details of an example of such an actuating mechanism 200 for opening the tool 100, according to an embodiment. As shown, the chamber 103 may fluidly communicate with the bore 101 by way of a fluid flow path. In particular, in this example, the fluid flow path may include a port 202 that extends radially through the first sub 102. The fluid flow path may also include an anterior annulus 204 defined between the first sub 102 and the uphole side of the housing 106. The anterior annulus 204 may be in communication with the port 202. The fluid flow path may extend from the anterior annulus 204 through the one-way valve assembly 112 to a posterior annulus 206 on the downhole side of the one-way valve assembly 112, defined between the first sub 102 and the housing 106, and finally terminating with the chamber 103.

Accordingly, pressure in the bore 101 may be communicated to the chamber 103 via the flow path. However, fluid flow from, and thus communication of pressure changes in, the bore 101 to the chamber 103 may be delayed by the one-way valve assembly 112. Thus, the pressure in the chamber 103 may lag or follow behind the pressure in the bore 101, and, correspondingly, pressure changes in the chamber 103 may be delayed with respect to pressure changes in the bore 101.

After this delay, pressure within the bore 101 may be bled out to a lower pressure. The one-way valve assembly 112 may serve to impede or block a corresponding reduction of pressure in the chamber 103, thereby trapping the higher pressure in the chamber 103 and achieving a differential pressure between the chamber 103 and the cavity 126 located within the bore 101. This may generate a force on the sleeve 108. Once this force reaches a predetermined magnitude, the shearable member 114 may break allowing the sleeve 108 to slide into the cavity 126. Referring additionally to FIG. 1, actuation of the sleeve 108 from the closed position to the open position may also be aided by the biasing member 107 (not depicted in FIG. 2) positioned in the chamber 103, which pushes the sleeve 108 toward the cavity 126. When the sleeve 108 is moved past the opening 105, the bore 101 communicates with the exterior of the tool 100 via the opening 105, and the tool 100 may be considered open.

Figure 3:
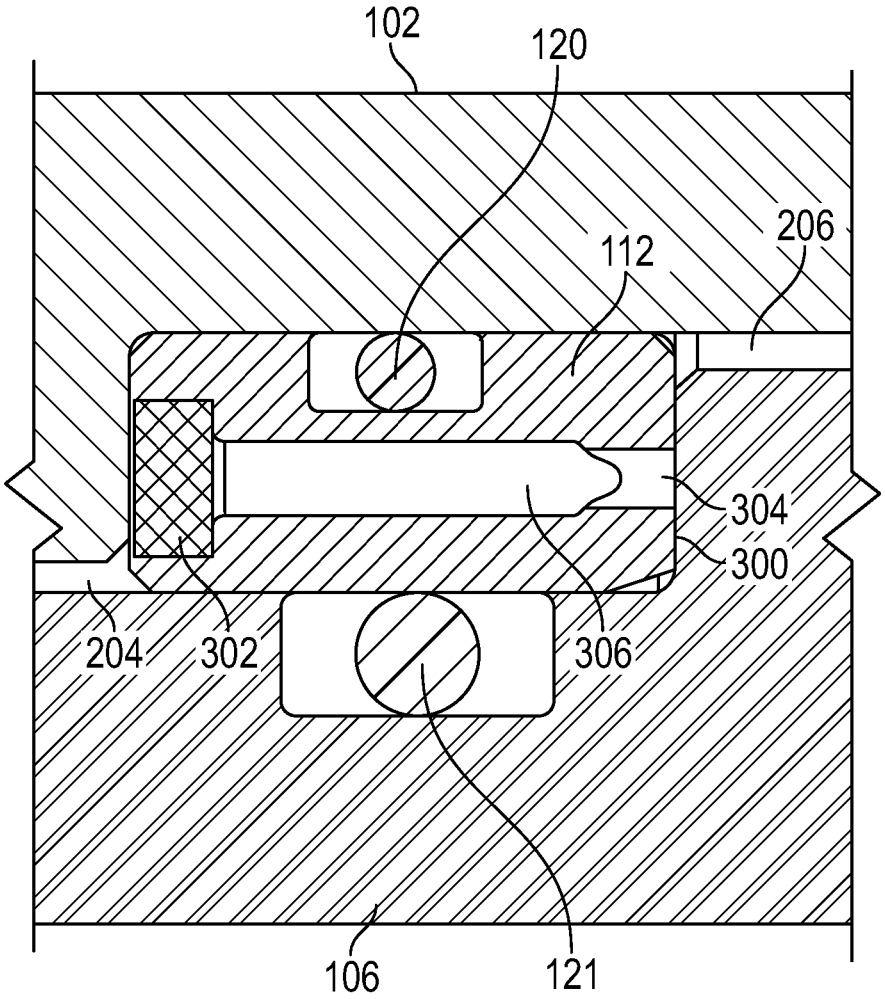
FIG. 3 illustrates an enlarged cross-sectional view of the actuating mechanism of the downhole tool, according to an embodiment.

FIG. 3 illustrates an enlarged view of the one-way valve assembly 112 of the actuating mechanism 200 of FIG. 2, according to an embodiment. The one-way valve assembly 112 may include a ring 300 defining one or more apertures 304 axially therethrough. The apertures 304 may fluidly communicate with the anterior and posterior annuli 204, 206. In some embodiments, the apertures 304 may be positioned approximately in the radial middle of the ring 300, e.g., generally half-way between the first sub 102 and the housing 106 in the radial direction, when the tool 100 is assembled. A check valve 306 may be located within the aperture 304 and may act as a choke e.g., restricting the rate of fluid flow through the aperture 304. The check valve 306 may further prevent backflow from the posterior annulus 206 into the anterior annulus 204. Seals 120, 121 may isolate fluid communication between the anterior annulus 204 and the chamber 103 funneling higher pressure fluid within the anterior annulus 204 through the one-way valve assembly 112.

A filter 302 may also be positioned in the fluid flow path, e.g., upstream of the aperture 304 (e.g., between the port 202 and the one-way valve assembly 112). The filter 302 may be a sintered metal filter, or any other filter media configured to prevent debris, particulate matter, etc., from entering and potentially blocking the aperture 304. In other embodiments, the fluid filter 302 may be positioned downstream from the aperture 304, or may be within the aperture 304. The filter 302 may be, in an embodiment, a 100 micron filter. In other embodiments, the filter 302 size may be larger or smaller, e.g., between about 10 microns and about 500 microns, about 50 microns and about 250 microns, or about 75 microns and about 150 microns. Further, the filter 302 may be configured to prevent particles of a certain size from passing into the posterior annulus 206. For example, the filter 302 may be configured to prevent particles of a size greater than or equal to about 0.001 inches, about 0.002 inches, about 0.003 inches, about 0.004 inches, about 0.005 inches, about 0.010 inches, or about 0.100 inches from passing through.

Figure 4:
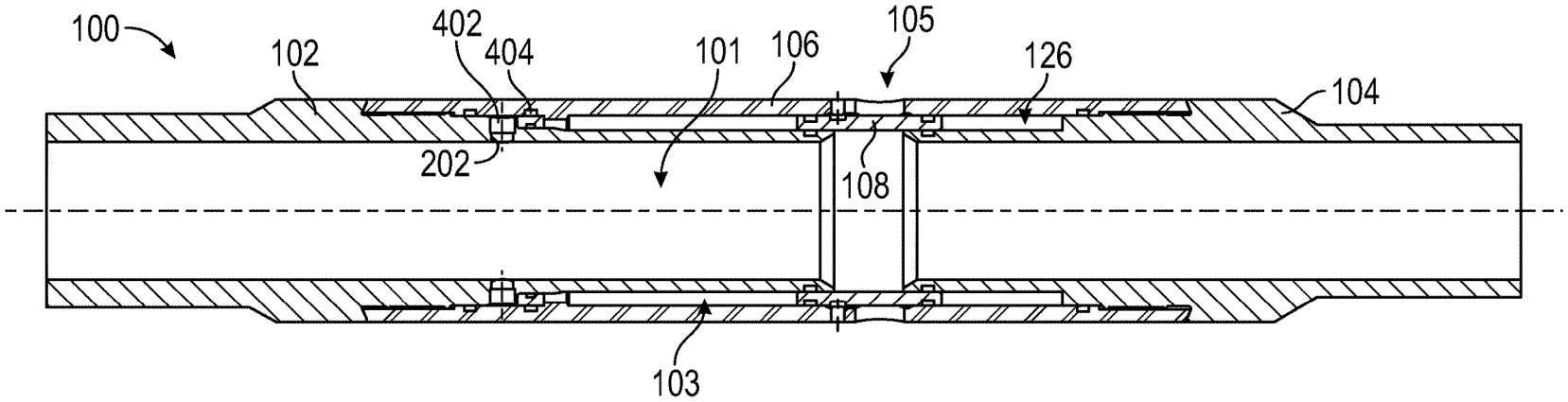
FIG. 4 illustrates a cross-sectional side view of another embodiment of the downhole tool.

FIG. 4 illustrates a cross-sectional side view of the tool 100, according to another embodiment. In this embodiment, the tool 100 may include one or more pressure barriers in the fluid flow path between the bore 101 and the chamber 103. For example, the one or more pressure barriers may be one or more frangible barriers, such as a rupture disk 402, as shown. In an embodiment, the rupture disk 402 may be positioned within the wall of the first sub 102 and may act as a barrier to fluid communication to the chamber 103 from the bore 101 until reaching a predetermined pressure differential across the rupture disk 402. Upon reaching the predetermined pressure differential, the rupture disk 402 may break (e.g., rupture or fracture) and allow fluid communication from the port 202 to the chamber 103. Such a configuration may aid in controlling when the tool 100 actuates for the first time. In other embodiments, the rupture disk 402 may be substituted or employed with other types of pressure barriers, such as one or more poppet valves, check valves, pressure-relief valves, etc.

In addition, as shown in FIG. 4, the flow restrictor of the actuating mechanism may be or include a choke 404. The choke 404 may be employed in addition to or instead of the one-way valve assembly 112 described above. The choke 404 may serve, similar to the check valve 306, to delay pressure buildup within the chamber 103 relative to that within the bore 101. However, although impeding and slowing the flow, the choke 404 may allow for bi-directional fluid flow between the chamber 103 and the bore 101 via the flow path.

As also shown in FIG. 4, the cavity 126 may be isolated from the bore 101, e.g., contained or defined in an annulus that is radially between the second sub 104 and the housing 106, and axially between the sleeve 108 and the second sub 104. For example, the sleeve 108 may seal with the housing 106 and the second sub 104, so as to prevent fluid communication from the bore 101 (or any other region exterior to the cavity 126) to the cavity 126. Accordingly, the cavity 126 may, for example, be held at ambient (topside) pressure or another pressure that is relatively low as compared to the pressure the bore 101 reaches, e.g., during casing pressure testing. When the pressure in the chamber 103 reaches a predetermined level, in response to increases in pressure in the bore 101 and after the aforementioned time delay, the pressure differential across the sleeve 108 may generate sufficient force to break the shearable member 114 and cause the sleeve 108 to slide farther into the isolated, low-pressure cavity 126, exposing the openings 105, e.g., without requiring a reduction in pressure in the bore 101.

Figure 5:
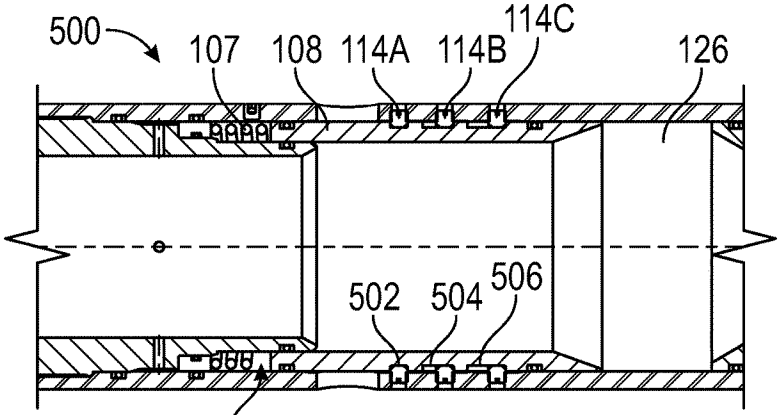
FIG. 5 illustrates a cross-sectional view of another downhole tool, according to an embodiment.

FIG. 5 illustrates a cross-sectional view of a portion of another downhole tool 500, according to an embodiment. The tool 500 may be similar to the tool 100 but may be configured to have multiple actuating actions. The sleeve 108 may define slots 502, 504, 506 in series. The slots 502, 504, 506 may be configured to receive shearable members 114A, 114B, 114C respectively at different sleeve 108 positions. Upon actuation, the first shearable member 114A may break, allowing the sleeve 108 to slide towards the cavity 126 by a predetermined distance until the next slot 504 bears upon the corresponding shearable member 114B. Continued, or potentially greater or lesser force, may be applied to break the second shearable member 114B, thereby allowing the sleeve 108 to continue sliding toward the cavity 126 by another (same or different) predetermined distance. This may repeat until there are no more shearable members to bear against. In the present embodiment, slot 506 is the final slot to bear against corresponding shearable member 114C, for a total of three actuating actions; however, this is but one specific example among many contemplated, and it will be appreciated that the tool 500 may be configured for any number of actuating actions (e.g., combinations of slots and shearable members).

Figure 6:
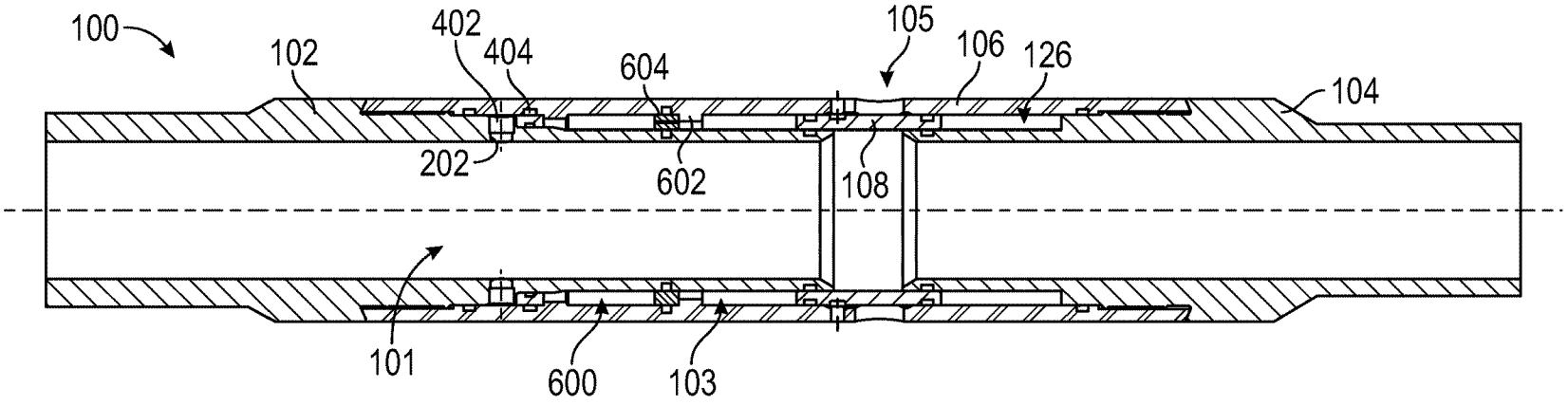
FIG. 6 illustrates a cross-sectional view of another embodiment of the downhole tool of FIG. 4.

FIG. 6 illustrates a side, cross-sectional view of the tool 100, according to another embodiment. In this embodiment, the tool 100 may include an intermediate chamber 600 in the flow path between the port 202 and the actuation chamber 103. A second pressure barrier, which may be a frangible barrier such as a rupture disk 604, may be position din the intermediate chamber 600, and may temporarily separate the intermediate chamber 600 from the actuation chamber 103. In an embodiment, the second rupture disk 604 may secured into a groove or against a shoulder 602, as shown.

Accordingly, in operation, the pressure in the bore 101 may increase to a first level, upon which the first rupture disk 402 may break, allowing fluid communication through the port 202 to the intermediate chamber 600 via the choke 404 (or another fluid restrictor). The fluid restrictor serves to delay the filling/pressurization of the intermediate chamber 600. The pressure in the intermediate chamber 600 may eventually rise to a second level, which may be the same, greater than, or less than the first level. At the second level, the second rupture disk 604 may break, allowing fluid flow from the intermediate chamber 600 to the actuation chamber 103. The filling/pressurization of the actuation chamber 103 may occur over a duration, as the flow restrictor may impede the movement of fluid from the bore 101 to the actuation chamber 103 via the port 202 and the intermediate chamber 600.

It will be appreciated that rupture disks 402 and/or 604 may be employed in embodiments in which the cavity 126 is exposed to the pressure of the bore 101 (e.g., as shown in FIG. 1). Further, any number of rupture disks 402/604 may be employed, with the illustrated embodiments incorporating one and two, respectively, being merely two examples among many contemplated. The burst pressure of the first rupture disk 402 may be the same as the burst pressure of the second rupture disk 604. Further, the burst pressures of the first and/or second rupture disks 402, 604 may be selected based upon a desired pressure in the bore 101, e.g., during casing pressure testing.

Figure 7:
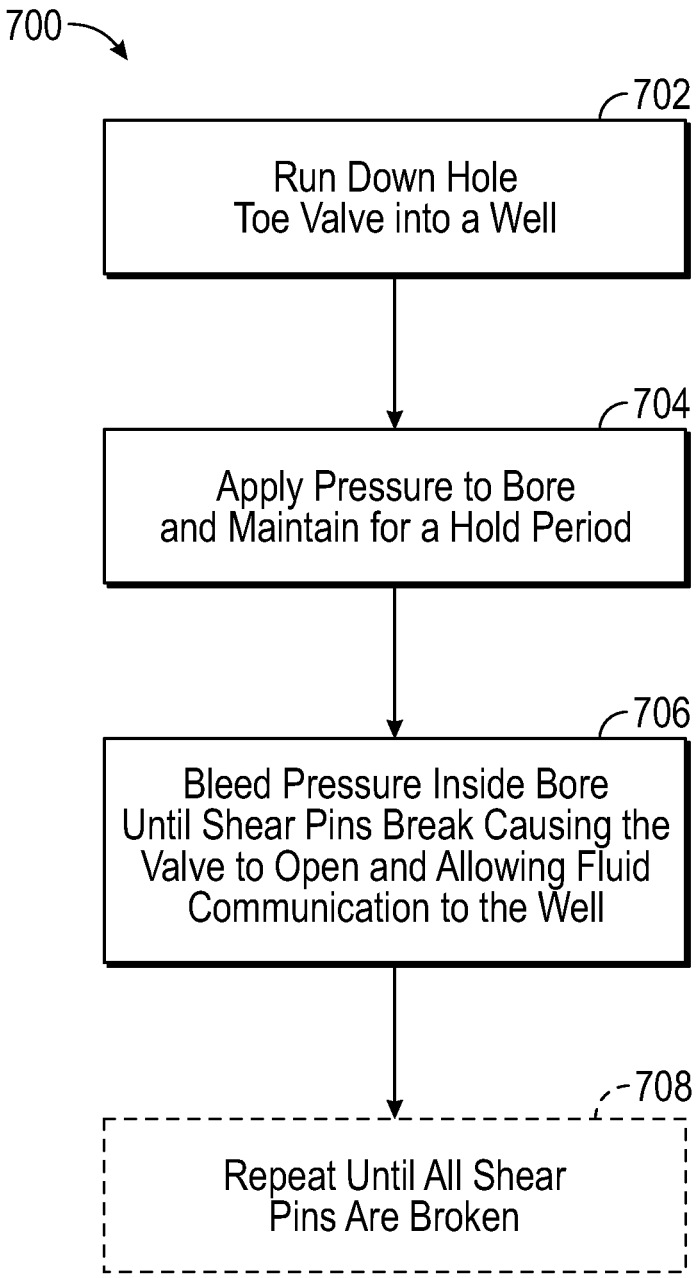
FIG. 7 illustrates a flowchart of a method for actuating the downhole tool, according to an embodiment.

FIG. 7 illustrates a flowchart of a method 700 for opening a valve, such as a toe valve, according to an embodiment. The method 700 may be executed by operation of one or more embodiments of the tool 100 (or 500) described above, and thus may be understood with reference thereto. However, it will be appreciated that some embodiments of the method 700 may be executed using other devices, and thus the method 700 is not limited to any particular structure unless otherwise stated herein. The tool 100 may be attached to a tubular, such as a casing pipe, at either end or at both ends, and may be part of a series of tubular attachments, i.e., a casing string. As at 702, the toe valve (e.g., tool 100) may be run into the well along with the casing string until a desired depth is reached.

The casing string may undergo a pressure test, which may involve applying pressure through the casing string and into the bore 101 of the tool 100, as at 704. Upon reaching a desired pressure within the bore 101, a hold period may follow. During this time, fluid within the bore 101 may communicate into the chamber 103 until the pressure within the chamber 103 equalizes with the pressure within the bore 101. The flow restrictor (e.g., check valve 306 and/or choke 404) may delay the pressure increase from the bore 101 into the chamber 103. Further, when the check valve 306 is provided, it may seal a compressed gas and liquid mixture within the chamber 103. Once the hold period has expired, pressure within the bore 101 may be bled to a lower pressure, as at 706.

At a predetermined bore pressure, the differential pressure across the sleeve 108 may cause the shearable member 114 to break, thereby releasing the sleeve 108 to eject into the cavity 126 and exposing openings 105 within the housing 106 to the bore 101 and allowing fluid communication from the bore 101 to the outside wellbore. The axial movement of the sleeve 108 may be aided by the biasing member 107 to ensure that the sleeve 108 reaches the next position.

Optionally, the valve (e.g., tool 500) may be configured to have multiple actuating actions, which may each be completed prior to the tool 500 opening. Accordingly, the pressure increasing at 704 and bleeding at 706 may repeat until the multiple actuators occur. For example, the shear pins 114A-C may be arranged in a series along the housing 106. The slots 502, 504, 506 within the sleeve 108 may be configured so that after the first actuation, the next set of shearable members 114B restrain the sleeve 108 until the aforementioned operation of the valve assembly is repeated.

In other embodiments, the increasing pressure at 704 may not need to be followed by bleed-down to create the sequence of actuations. Rather, the increasing pressure itself (whether applied, hydrostatic, or both) may cause the multiple actuations, e.g., with a time delay between each such actuation as the fluid fills the increasing size of the actuation chamber 103 after each time the sleeve 108 moves.

Further, in some embodiments, the bleed-down of the pressure of the bore 101 may not cause the actuation. Rather the increase in the bore 101 pressure may be communicated to the chamber 103 over time, which may result in a pressure differential building between the chamber 103 and an isolated cavity 126 on an opposite axial side of the sleeve 108, as noted above.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a first sub defining a port extending radially therethrough;

a second sub spaced axially apart from the first sub;

a housing connected with the first and second subs, the housing defining an opening radially therethrough, wherein the first sub, the second sub, and the housing together define a bore axially therethrough, the port being in fluid communication with the bore;

a valve element disposed at least partially within the housing, wherein the valve element is movable from a closed position to an open position, wherein, when the valve element is in the closed position, the valve element blocks fluid communication between the bore and the opening, and when the valve element is in the open position, fluid communication between the bore and the opening is permitted;

an actuation chamber defined between the first sub, the housing, and the valve element, the actuation chamber being in fluid communication with the bore via a flow path that includes the port, wherein the valve element is configured to move from the closed position to the open position in response to a pressure differential between the bore and the actuation chamber; and a flow restrictor positioned in the flow path, wherein the flow restrictor is configured to slow or stop fluid flow from the actuation chamber to the bore via the flow path, and allow fluid flow from the bore to the actuation chamber via the flow path, such that the pressure differential between the bore and the actuation chamber is generated by increasing a pressure in the bore and then decreasing a pressure in the bore.

2. The tool of claim 1, wherein the flow restrictor comprises a check valve, and wherein the check valve is configured to prevent flow from the actuation chamber to the port via the flow path.

3. The tool of claim 1, wherein the flow restrictor comprises a choke that is configured to allow bi-directional fluid flow between the actuation chamber and the port via the flow path.

4. The tool of claim 1, further comprising one or more shearable members configured to hold the valve element in the closed position until a predetermined pressure differential between the actuation chamber and the bore is reached, the one or more shearable members being configured to break, releasing the valve element, in response to reaching the predetermined pressure differential.

5. The tool of claim 4, wherein the one or more shearable members connect the valve element to the housing until the one or more shearable members break.

6. The tool of claim 4, wherein the one or more shearable members comprise a plurality of shearable members, wherein the valve element defines a plurality of grooves, and wherein respective grooves of the plurality of grooves are configured to receive respective shearable members of the plurality of shearable members.

7. The tool of claim 6, wherein the plurality of shearable members are configured to break in a sequence of two or more breaks, such that the valve element travels a predetermined distance between the two or more breaks.

8. The tool of claim 1, further comprising one or more pressure barriers disposed within the flow path.

9. The tool of claim 8, wherein a first one of the one or more pressure barriers comprises a frangible barrier positioned in the port of the first sub.

10. The tool of claim 8, wherein the one or more pressure barriers comprise a first frangible barrier and a second frangible barrier, the tool further defining an intermediate chamber between the first sub and the housing, the intermediate chamber being in the flow path between the port and the actuation chamber, the first frangible barrier blocking fluid communication from the port to the intermediate chamber until the first frangible barrier breaks, and the second frangible barrier blocking fluid communication from the intermediate chamber to the actuation chamber until the second frangible barrier breaks.

11. The tool of claim 1, further comprising a filter positioned within the flow path between the flow restrictor and the bore.

12. The tool of claim 11, wherein the filter is positioned between the flow restrictor and the port.

13. The tool of claim 1, wherein the flow path comprises an anterior annulus between the first sub and the housing and on a first side of the flow restrictor, and a posterior annulus between the first sub and the housing on a second side of the flow restrictor, and wherein the bore is in fluid communication with the actuation chamber via the port, the anterior annulus, the flow restrictor, and the posterior annulus.

14. The tool of claim 1, further comprising a biasing member that is configured to apply a force on the valve element toward the open position.

15. The tool of claim 14, wherein the biasing member comprises a spring positioned within the actuation chamber.

16. The tool of claim 1, wherein the flow restrictor is configured to slow fluid flow from the bore to the actuation chamber and to slow fluid flow from the actuation chamber to the bore.

17. A method for operating a downhole tool, comprising:

deploying the downhole tool into a wellbore, the downhole tool comprising a sleeve that is initially held in a closed position, wherein the sleeve in the closed position blocks fluid communication between a central bore of the downhole tool and an exterior of the downhole tool via an opening in the downhole tool;

causing an increase in a pressure in the central bore;

maintaining the pressure in the central bore at least until a pressure in an actuation chamber defined within the downhole tool reaches an actuation pressure, wherein pressure changes in the actuation chamber are delayed with respect to pressure changes in the central bore, and wherein the pressure in the actuation chamber is applied to the sleeve and the pressure in the central bore is applied to the sleeve; and producing a pressure differential across the sleeve by reducing the pressure in the central bore, such that the pressure in the actuation chamber is greater than the pressure in the central bore which results in the pressure differential across the sleeve, wherein producing the pressure differential causes the sleeve to move a first time toward an open position, and wherein the sleeve in the open position exposes the opening to the central bore for allowing communication between the central bore and the exterior of the downhole tool.

18. The method of claim 17, wherein the sleeve is initially held in the closed position by one or more shearable members.

19. The method of claim 17, wherein the downhole tool comprises:

a first sub defining a port extending radially therethrough;

a second sub spaced axially apart from the first sub;

a housing connected with the first and second subs, the housing defining the opening radially therethrough, wherein the first sub, the second sub, and the housing together define the central bore therethrough, the port being in fluid communication with the central bore, and wherein the actuation chamber is defined between the first sub, the housing, and sleeve, the actuation chamber being in fluid communication with the central bore via a flow path that includes the port; and a flow restrictor positioned in the flow path, wherein the flow restrictor is configured to delay fluid communication from the central bore to the actuation chamber via the flow path.

20. The method of claim 19, further comprising again increasing the pressure in the central bore, again maintaining the pressure in the central bore, and again reducing the pressure to move the sleeve a second time.

21. The method of claim 20, wherein the downhole tool comprises a plurality of shearable members connected to the sleeve, the plurality of shearable members being positioned so as to break in series such that the sleeve moves the first time, is stopped, and then moves a second time.

22. The method of claim 19, wherein the downhole tool comprises a plurality of shearable members connected to the sleeve, the plurality of shearable members being configured to break in series in response to applied or hydrostatic pressure.

23. The method of claim 17, wherein the pressure changes in the actuation chamber are delayed with respect to the pressure changes in the central bore by a flow restrictor configured to slow or stop fluid flow from the actuation chamber to the central bore, and allow fluid flow from the bore to the actuation chamber, such that changing pressure in the central bore results in different pressures, at least temporarily, between the central bore and the actuation chamber.

24. A downhole tool, comprising:

a first sub defining a port extending radially therethrough;

a second sub spaced axially apart from the first sub;

a housing connected with the first and second subs, the housing defining an opening radially therethrough, wherein the first sub, the second sub, and the housing together define a bore axially therethrough, the port being in fluid communication with the bore;

a valve element disposed at least partially within the housing, wherein the valve element is movable from a closed position to an open position, wherein, when the valve element is in the closed position, the valve element blocks fluid communication between the bore and the opening, and when the valve element is in the open position, fluid communication between the bore and the opening is permitted;

an actuation chamber defined between the first sub, the housing, and the valve element, the actuation chamber being in fluid communication with the bore via a flow path that includes the port, wherein the valve element is configured to move from the closed position to the open position in response to the actuation chamber being at a higher pressure than the bore; and a flow restrictor positioned in the flow path, wherein the flow restrictor is configured to choke or stop fluid flow from the actuation chamber to the bore via the flow path, and choke fluid flow from the bore to the actuation chamber via the flow path, such that a pressure differential between the bore and the actuation chamber is generated by increasing the pressure in the bore, which increases the pressure in the actuation chamber, and then decreasing the pressure in the bore.

* * * * *